United States Patent [19]

Cseh

[11] 3,996,903

[45] Dec. 14, 1976

[54] INTERNAL COMBUSTION ENGINE

[76] Inventor: Ferenc Cseh, 37 Passaic St., Passaic, N.J. 07055

[22] Filed: June 1, 1971

[21] Appl. No.: 148,598

[52] U.S. Cl. ..... 123/74 AA; 123/74 A; 123/65 S; 123/59 BS; 123/66

[51] Int. Cl.[2] ..... F02B 33/12

[58] Field of Search ..... 123/65, 65 B, 65 VD, 123/65 S, 59 BS, 66, 74 A, 74 AA

[56] References Cited

UNITED STATES PATENTS

| | | | |
|---|---|---|---|
| 792,119 | 6/1905 | Clifton | 123/65 B |
| 838,926 | 12/1906 | Walsh et al. | 123/65 VD |
| 1,157,932 | 10/1915 | Evers | 123/65 B |
| 1,711,906 | 5/1929 | Sands | 123/66 |
| 1,717,811 | 6/1929 | Rummler | 123/74 AA |
| 2,445,148 | 7/1948 | Minnix | 123/66 |
| 2,447,041 | 8/1948 | Sues | 123/66 |
| 2,586,621 | 2/1952 | Delaage | 123/74 A |
| 2,899,946 | 8/1959 | Lyvers | 123/74 A |
| R15,031 | 1/1921 | Weger | 123/65 B |

*Primary Examiner*—Ronald H. Lazarus

[57] ABSTRACT

In a two-stroke cycle internal combustion engine a noncompression type pump formed by placing a plate-like secondary piston within a primary piston, between the top and the wrist pin. The reciprocating movements of primary and secondary piston in conjunction with the intake port and transfer port, provide a pump with a longer intake time and less power need, relative to prior art.

2 Claims, 17 Drawing Figures

FIG.1
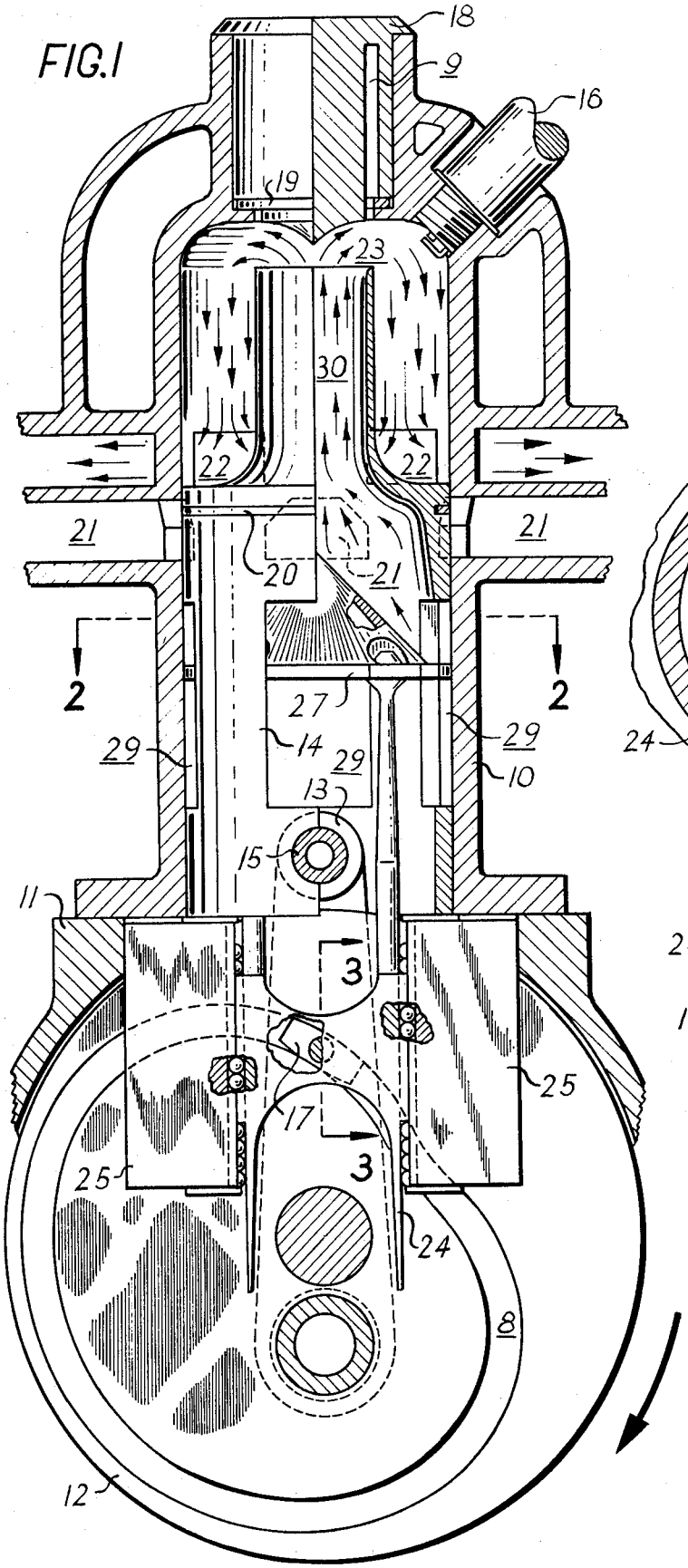
FIG.2
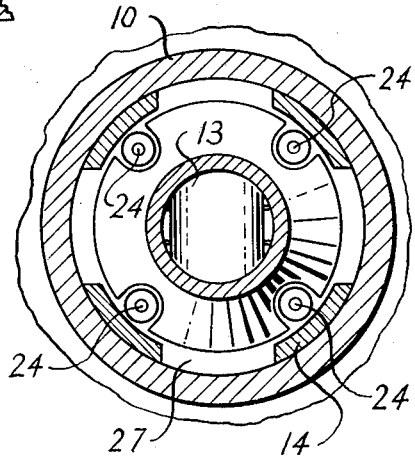
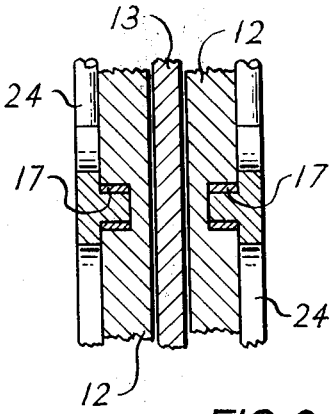
FIG.3

FIG.10
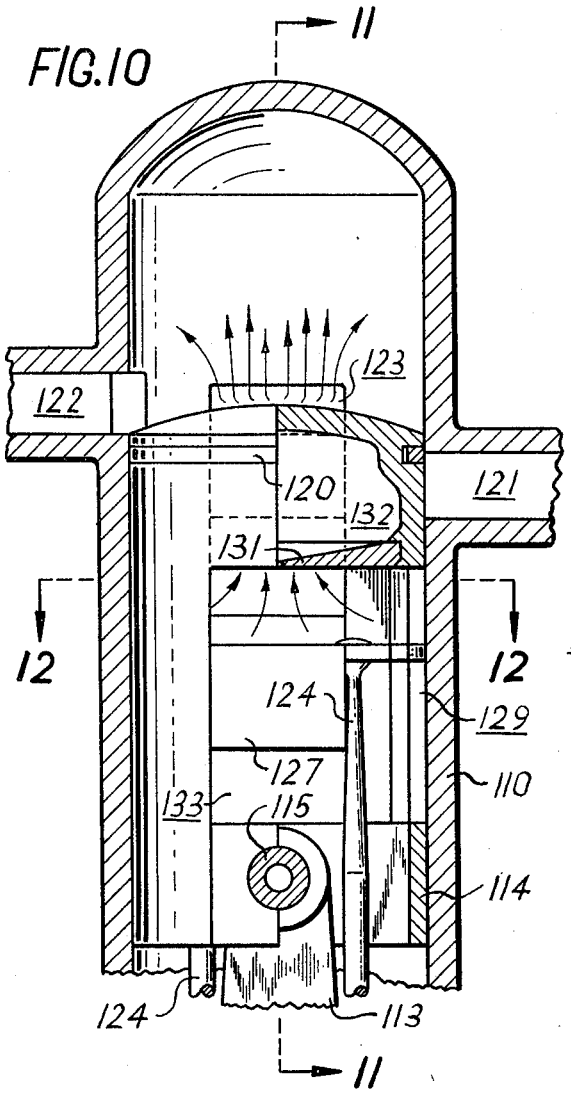
FIG.11
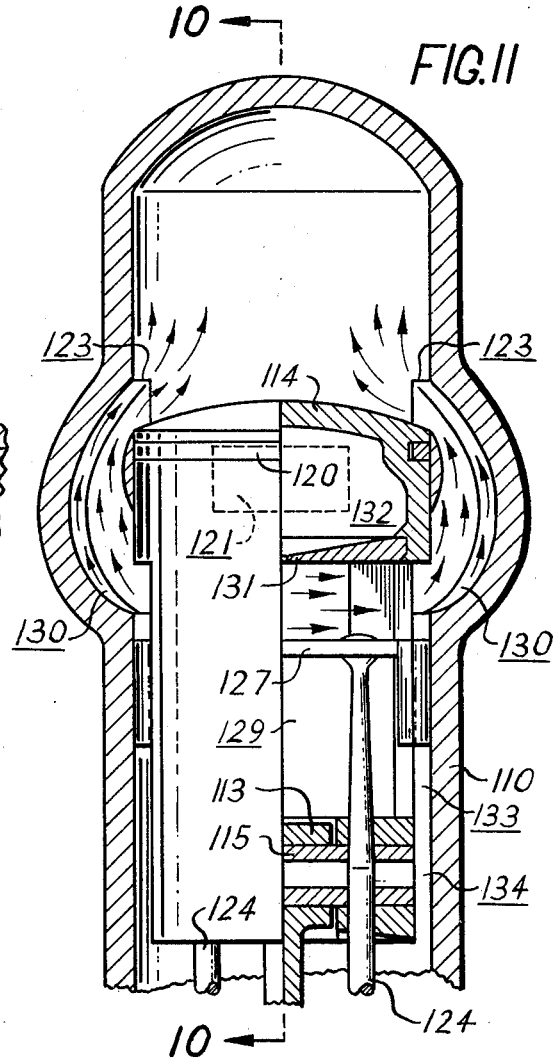
FIG.12
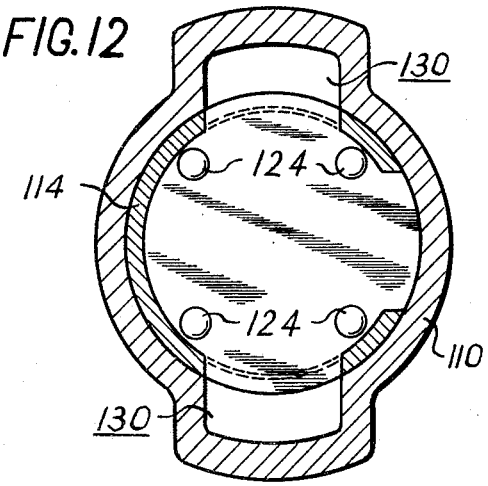
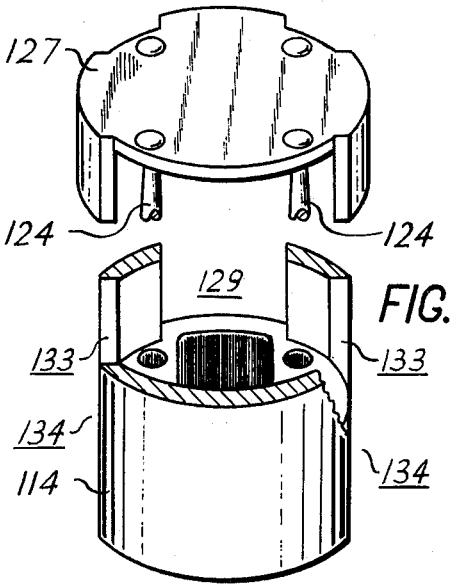
FIG.13

INTERNAL COMBUSTION ENGINE

One of these invention species employs substance of an invention, described in a previously filed application by the inventor on Feb. 22, 1971. The Ser. No. is 117,398. The U.S. Pat. No. is 3,749,066.

This invention relates generally to the two-stroke engines and more particularly to the high performers. The contemporary high performer two-stroke engine employs a compression type pump, with an intake time of about 120°, or about 180°. The pump is further characterized by the facts, that a significant portion of intake time is blow-back time and a significant portion of transfer time is suck-back time, at lower revolution per minute. Furthermore, the sucked in volume is significantly less than the piston displacement of the engine, and in operation the power consumption is significant.

The object of this invention is to provide a noncompression type pump for a two-stroke engine which creates great suction force, and consumes much less power in operation than the commercially feasible two-stroke engines of the past. The great suction force at intake port is inherently coupled with great pressure potential at the transfer port of the engine which is the outlet of the pump. An other object of this invention is to increase the intake time to about 240°, by adding the time of eliminated compression cycle. An other object of this invention is to reduce blow-back time and eliminate suck-back time. An other object of this invention is the feasibility that the sucked in volume is equal to the piston displacement of the engine. A pump with these characters is a prerequisite to a two-stroke engine which produces very high specific power output at very high revolution per minute. An other object of this invention is that the invention is adaptable to most scavenging systems found in commercially sold engines, and a conveniently located intake port.

This is accomplished by combination of detail construction and operational features which distinguish the invention from the commercially feasible two-stroke engine pumps of the past. Such feature may be listed as follows:

To decrease the volume of pump chamber which varied by the movement of a piston, the air pockets of the crankcase and piston has been eliminated, remaining only the volume of transfer passage against the volume of piston displacement. It is executed by placing a plate-like secondary piston within, now primary piston, between the wrist pin and the top. The secondary piston is reciprocable within the primary piston and both of them reciprocable within the cylinder, in timed relation. The sucked in fuel-air mixture is directed over the top of secondary piston. The primary piston is equipped with means to cover exhaust port, and to open intake port when primary piston is in upper position. The upper portion of primary piston is connected to lower portion with post or posts which pass through or beside secondary piston and may function as cover to exhaust port when primary piston is in upper position. The secondary piston may be more than one piece or subsequently formed.

For a fuller understanding of the nature and objects of the invention, reference should be had to the following detailed description taken in connection with the accompanying drawings, in which:

FIG. 1 is a side elevational view in section, some parts broken away, an embodiment of present invention. It is a two-stroke engine, employing straight scavenging system, the primary piston is in bottom dead center position.

FIG. 2 is a transverse section, taken on line 2—2 of FIG. 1.

FIG. 3 is a vertical section, taken on line 3—3 of FIG. 1.

FIG. 10 is a side elevational view of a loop scavenging two-stroke engine, embodied the present invention on it. Some vertical section has taken on line 10—10 of FIG. 11, some parts broken away. The primary piston is in bottom dead center position.

FIG. 11 is a front elevational view of the loop scavenging two-stroke engine, embodied the present invention on it. Some vertical section has taken on line 11–11 of FIG. 10, some parts broken away. The primary piston is in bottom dead center position.

FIG. 12 is a transverse section, taken on line 12—12 of FIG. 10.

FIG. 13 is a perspective view of secondary piston and some portion of primary piston.

Figure 14:
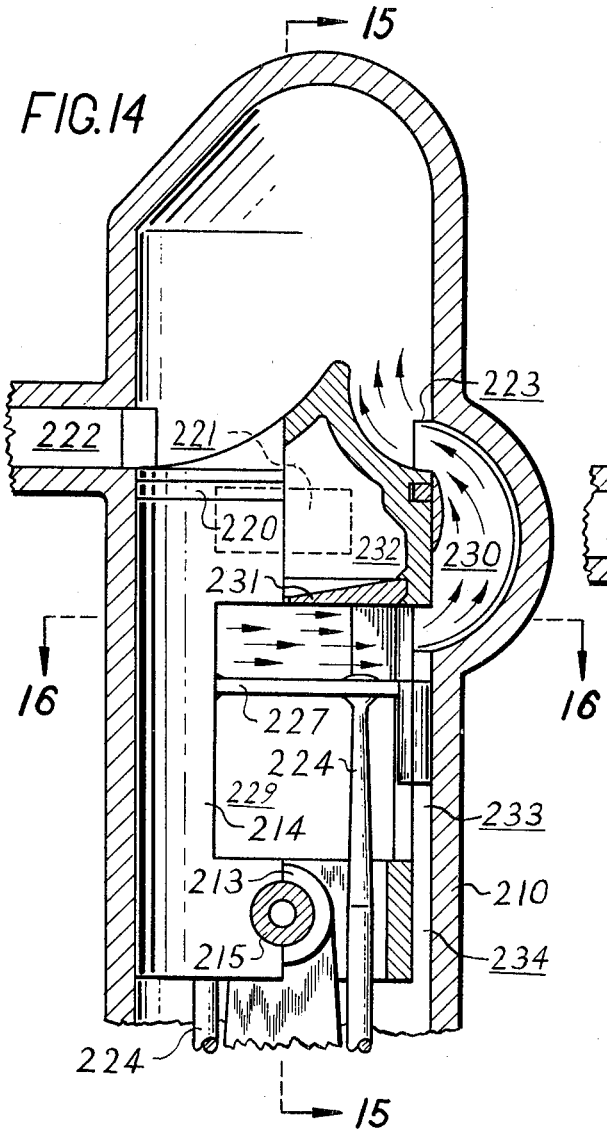

FIG. 14 is a side elevational view of the cross scavenging two-stroke engine, embodied the present invention on it. Some vertical section has taken on line 14—14 of FIG. 15, some parts broken away. The primary piston is in bottom dead center position.

Figure 15:
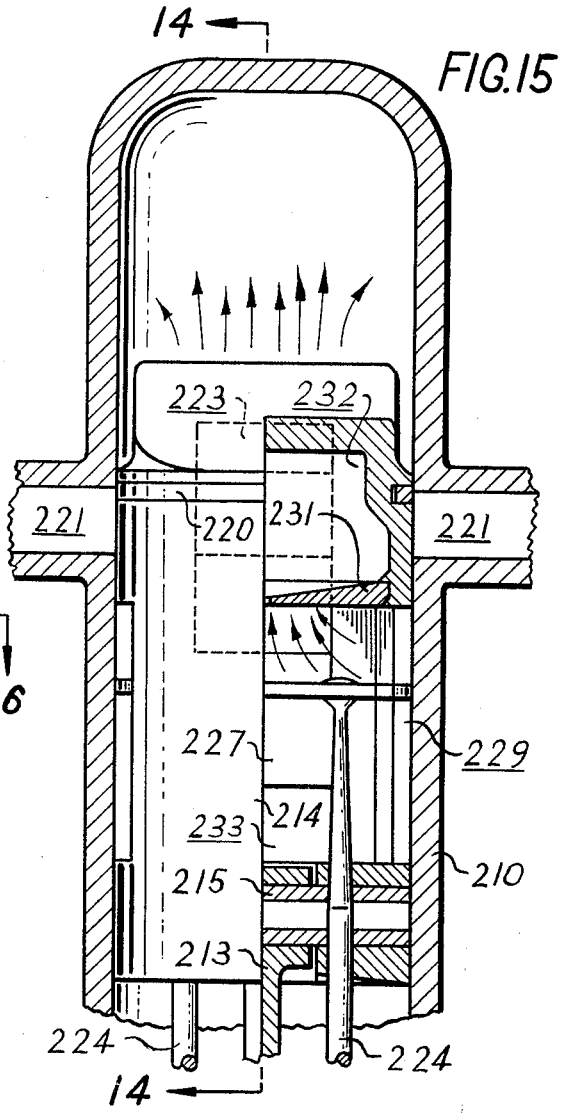

FIG. 15 is a front elevational view of the cross scavenging two-stroke engine, embodied the present invention on it. Some vertical section has taken on line 15—15 of FIG. 14, some parts broken away. The primary piston is in bottom dead center position.

Figure 16:
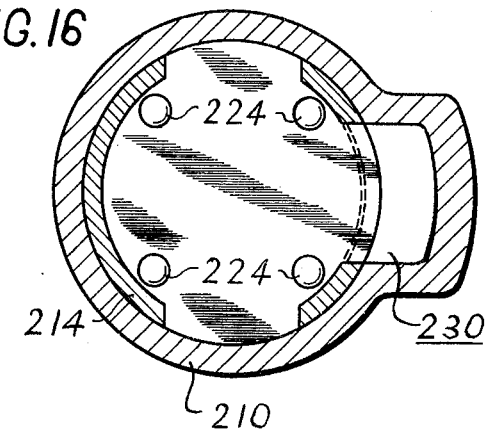

FIG. 16 is a transverse section taken on line 16—16 of FIG. 14.

Figure 17:
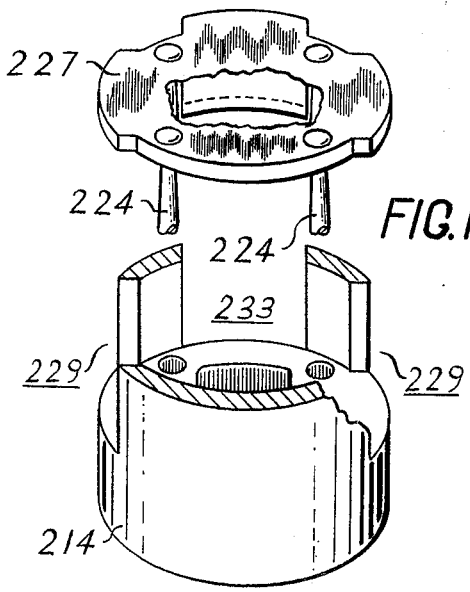

FIG. 17 is a perspective view of secondary piston and some portion of primary piston.

With careful study of these drawings, it may be seen how the figures help each other to understand the instant invention. Certain conventional details of construction which do not pertain to the invention per se have been eliminated for sake of clarity.

Referring to FIG. 1, the numeral 10 designates generally a cylinder. In accordance with conventional practice, the cylinder 10 communicates with crankcase 11 which houses the crank shaft 12 in bearings not shown. The crank shaft 12 is pivotally connected, again in conventional fashion, to the piston rod 13 which is pivotally connected to the lower portion of the stepped tube-like primary piston 14 through wrist pin 15. Thus the reciprocation of slidingly and sealingly mounted primary piston provides the usual rotary motion of crank shaft 12. The crank shaft 12 has grooves 8 to form cams and to accommodate the cam followers 17 which pivotally connected to push rods 24, embedded with rolling balls on bed plates 25. The upper ends of push rods 24 are connected to the secondary piston 27 which mounted slidingly and sealingly within the primary piston 14 and cylinder 10. Thus, the rotary motion of crank shaft 12 provides the reciprocation of secondary piston 27, determined by the cams pattern. The cylinder 10 is covered at upper end, equipped with spark plug 16, protruding into annular combustion chamber. The upper end incorporates a deflector 18 and a seal 19. The deflector 18 incorporates the annular cavity 9 which accommodates the transfer conduit of primary piston 14 when it is in upper position. The transfer conduit fits into the upper end of cylinder 10 and seal 19 slidingly and sealingly. The upper portion of primary piston 14 is sealed with ring 20. The cylinder 10 is equipped with exhaust ports 22, spaced to and controlled by the top edge of primary piston 14. The cylinder 10 is equipped with intake ports 21, spaced to and controlled by the upper edges of windows 29 on primary piston 14. The plate-like secondary piston 27 has a cone shape to reduce the volume of transfer passage 30 and practically eliminate the air pocket between the two piston when they get closest during operation. The height of transfer port 23 is the same as the upper edges of windows 29 are from the lower edges of intake ports 21 when primary piston is in bottom dead center position. This specimen having an intake time of 240° crank shaft rotation and a transfer time of 120° of crank shaft rotation.

In FIG. 2 has shown the secondary piston 27 in detail and the connecting posts section of primary piston 14.

In FIG. 3 has shown the relation of cam followers 17 to crank shaft 12 and to push rods 24, in section.

It is believed that the invention will be more clearly understood from a consideration of the operation of the apparatus just described, and such a description follows herewith.

Figure 4:
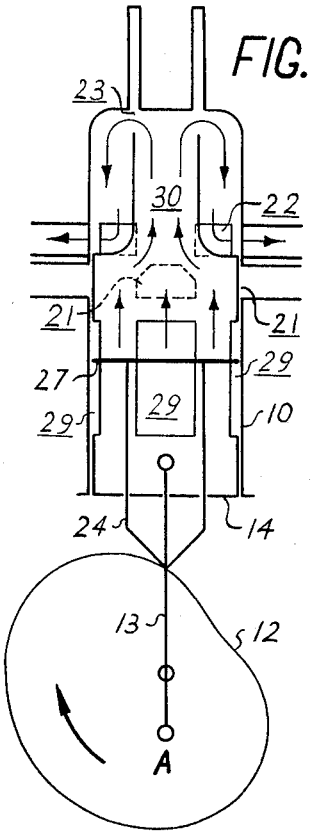
FIGS. 4–9 are schematic views of FIG. 1 in various stages of a cycle of operation, as would occur according to the teachings of the invention.
Figure 5:
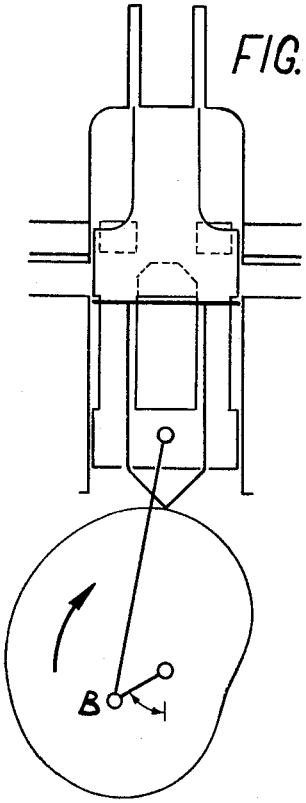
Figure 6:
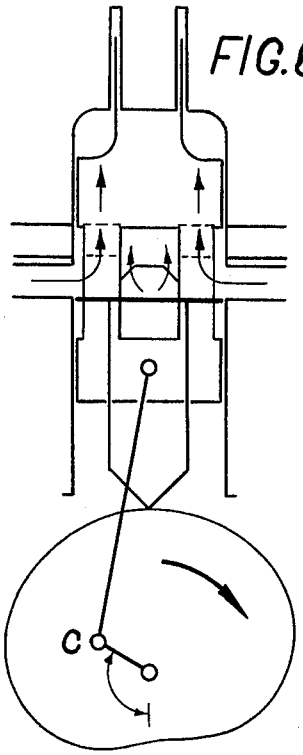
Figure 7:
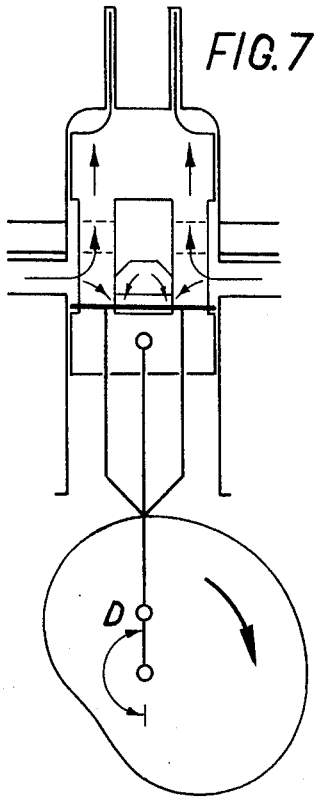
Figure 8:
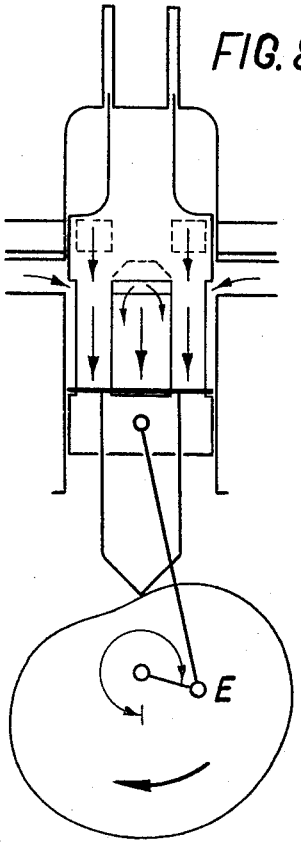
Figure 9:
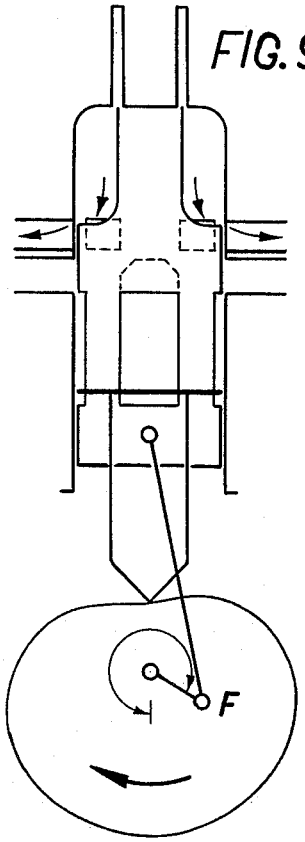

As seen in FIG. 4, the primary piston is in bottom dead center position. In this position the scavenging process takes place. The trapped fuel-air mixture, located over the top of secondary piston 27, is pressed through transfer port 23 by rapid upward movement of secondary piston 27. The transferring fuel-air mixture expulsing the remains of exhaust gases through exhaust ports 22, and provides a new charge for the cylinder. As crank shaft 12 rotates in the marked direction, the primary piston 14 and the secondary piston 27 is moving upward, accelerating. As crank shaft 12 reaches the 10° position, the secondary piston 27 reached its maximum speed and with further rotation of crank shaft 12, the secondary piston 27 is moving upward, decelerating. At approximately 48° position of crank shaft 12, the upper edge of secondary piston 27 gets closest to the upper edges of windows 29 in race to the lower edges of intake ports 21. At position B as seen in FIG. 5, the crank shaft rotated 60°. The upper edges of windows 29 are at the lower edges of intake ports 21, the upper edge of secondary piston 27 is in lower position than the lower edges of intake ports 21, in preparation to a stop. A new charge delivered into the cylinder, thus the transfer port 23 gets closed, the transfer time ends and the intake time begins. At 75° position of crank shaft 12, the secondary piston 27 arrived to its top position and stopped. The top surface edge of secondary piston 27 is flush with the lower edges of intake ports 21. The primary piston 14 with its upper position created a depression potential, thus the inflow of fuel-air mixture is under way through approximately one third open intake ports 21. As crank shaft 12 rotates further, the primary piston 14 rises further, opens the intake ports 21 completely at approximately 97° position. Further rotation of crank shaft 12 create greater depression potential with upward movement of primary piston 14 over now stationary secondary piston 27, thus more fuel-air mixture flows into pump chamber. When crank shaft 12 turned to the 120° position C as seen in FIG. 6, approximately one half of the volume equal piston displacement has flown in. At position C the motionless condition of secondary piston 27 has ended. With further rotation of crank shaft 12 the primary piston 14 moves upward, the secondary piston 27 moves downward until the crank shaft 12 turns to position D as seen in FIG. 7. At position D the primary piston 14 is in top dead center position and approximately 90 percent of the volume equal piston displacement has flown into pump chamber. Further rotation of crank shaft 12 moves the primary piston 14 downward with secondary piston 27. At 195° position of crank shaft 12, the secondary piston 27 gets closest to the lower portion of primary piston 14 and sustain relative position until crank shaft 12 turns to position E as seen in FIG. 8. At position E the crank shaft rotated approximately 280°. While both piston move downward with sustained spacing, the volume of pump chamber will increase, due to the fact that the effective surface area of secondary piston 27 is larger than the effective surface area of primary piston 14. At position E of crank shaft 12 a volume equal piston displacement of fuel-air mixture has flown through intake ports 21. With further rotation of crank shaft 12 the primary piston 14 moves downward, decelerating, but the secondary piston 27 may not follow because it has to come to a stop at 305° crank shaft position. The relative slow down of secondary piston 27 results a blow-back time of approximately 9 percent of intake time. The blow-back volume is approximately 8 percent of volume equal piston displacement at near zero revolution per minute. At the start of blow-back time the intake ports 21 are less than half way open. The blow-back time and volume may be eliminated with different dimensions and inertia forces. At position F as seen in FIG. 9, the crank shaft 12 rotated 300°, the upper edges of windows 29 are at the lower edges of intake ports 21 thus they get closed. The trapped charge is ready to be delivered through transfer port 23 thus it opens. The secondary piston 27 is near to bottom end position, the intake time ends and the transfer time begins. At 305° position of crank shaft 12 the secondary piston 27 arrived to its bottom end position and stopped. The downward moving primary piston 14 forcing the trapped charge through transfer port 23. With further rotation of crank shaft 12 the primary piston 14 moves downward and the secondary piston 27 moves upward. The desired result is that the major portion of volume equal piston displacement is delivered through transfer port 23 before primary piston 14 gets into bottom dead center position as seen in FIG. 4.

For additional embodiment of present invention, selected the loop scavenging type two-stroke engine, illustrated on FIG. 10, FIG. 11, FIG. 12, FIG. 13.

The numbering system employed follows that of FIG. 1, but with the addition of 100 to numerals for similar elements. Thus, the numeral 110 designates a cylinder, attached to crankcase not shown. The piston rod 113 pivotally connected to the lower portion of primary piston 114 through wrist pin 115. The primary piston 114 is slidingly and sealingly mounted in cylinder 110 with ring 120. The cylinder 110 having exhaust port 122 and transfer ports 123, they are fully open when the primary piston 114 is in bottom dead center position. The intake port 121 is fully closed when the primary piston 114 is in lower position. The upper end of primary piston 114 is lightened with a cavity 132 and covered with a heat sink plate 131. The mid portion of primary piston 114 has a window 129 to open intake port 121, and windows 133 to open the entrances of transfer passages 130. The mid portion of primary piston 114 accommodates the secondary piston 127, reciprocable slidingly and sealingly within primary piston 114 and cylinder 110. The lower portion of primary piston 114 has two notches 134 to accommodate the cover plates of secondary piston 127 when the secondary piston 127 is closest to the lower portion of primary piston 114 during operation. Said cover plates are to seal pump chamber when secondary piston 127 is in upper position. The primary piston 114 reciprocates in conventional fashion as seen in FIG. 1, not shown. The secondary piston 127 is connected to push rods 124 which are part of the cam mechanism described at FIG. 1, not shown. The lower edge of intake port 121 is spaced to the upper edge of window 129. The upper surface edge of secondary piston 127 is flush with the lower edge of intake port 121 and its cover plates fully cover the entrances of transfer passages 130 when secondary piston 127 is in top end position. The connecting and covering function of posts, mid portion of primary piston 114, may be separated in different construction. The fact, that the volume of pump chamber does not increase when the primary and secondary piston moves downward with sustained spacing, requires slightly different consideration to cam design.

The operation of present invention, embodied in a loop scavenging type two-stroke engine is identical to the operation of present invention, embodied in a straight scavenging type two-stroke engine.

For additional embodiment of present invention, selected the cross scavenging type two-stroke engine, illustrated on FIG. 14, FIG. 15, FIG. 16 and FIG. 17.

The numbering system employed follows that of FIG. 10, FIG. 11, FIG. 12 and FIG. 13 but with the addition of 100 to numerals for similar elements. The overwhelming similarity in construction to the embodiment in the loop scavenging type two-stroke engine, dictates to restrict the description to the inherently made differences. The inherent difference is that the transfer ports moved to opposed of exhaust port, thus reduced to one. With it moved the transfer passages and related windows, cover plates, notches. The intake port and related window moved to the location where the transfer ports were, thus doubled.

The operation of present invention, embodied in a cross scavenging type two-stroke engine is identical to the operation of present invention, embodied in a loop scavenging type two-stroke engine.

It may be seen at this stage, that the present invention in pure embodiment, not shown, having virtues, characteristics such as: intake time plus transfer time equal 360°, symmetrical intake and transfer timing, no blowback time and no suck-back time, the intook volume equal piston displacement, noncompressing treatment of charge, the volume of transfer passage against the piston displacement at the end of transfer time. These virtues, characters are coupled with somewhat larger dimensions and inertia forces, suggest limited application. Various practical applications demand to deviate from pure embodiment, as shown in these species, without effect on spirit and scope of present invention.

While in the foregoing specification a detailed description of the invention has been given for the sake of clearly teaching the invention, it is to be understood that the invention is not intended to be limited to the specific embodiments herein shown. It will be readily apparent to those skilled in the art that many variation in details thereof may be made without departing from the spirit and scope of the invention.

I claim:

1. A pump, in a two-stroke internal combustion engine, with the character described comprising:

A. a working cylinder
  1. has an intake port between the ends thereof
  2. having a transfer port at the upper end
  3. has an exhaust port between the ends thereof B. a working primary piston, stepped tube type
  1. reciprocable in said working cylinder, between upper and lower position
  2. has means to open the said intake port
  3. closes the said intake port at lower position
  4. opens the said transfer port at lower position
  5. opens the said exhaust port at lower position C. a secondary piston
  1. fits in the said working primary piston
  2. fits in the said working cylinder
  3. reciprocable, substantially under the said intake port, between upper and lower position D. a means
  1. provides a timed relation between the movements of said working primary piston and said secondary piston E. and means mounting said working primary piston in said working cylinder for reciprocal motion between a top dead center position in which a fresh charge admitted over the said secondary piston through the said intake port and a bottom dead center position in which the essentially noncompressed said fresh charge over the said secondary piston passing through a transfer passage and said transfer port to aid in expelling exhaust gases through said exhaust port.

2. A pump, in a two-stroke internal combustion engine, with the character described comprising:

A. a working cylinder
  1. has an intake port between the ends thereof
  2. has a transfer passage between the ends thereof
  3. has an exhaust port between the ends thereof B. a working primary piston, hollow type
  1. reciprocable in said working cylinder, between upper and lower position
  2. has means to open the said intake port
  3. closes the said intake port at lower position
  4. has means to open the entrance of said transfer passage at lower position
  5. opens a transfer port of said transfer passage at lower position
  6. opens the said exhaust port at lower position C. a secondary piston
  1. fits in the said working primary piston
  2. fits in the said working cylinder
  3. reciprocable, substantially under the said intake port and the said entrance of transfer passage, between upper and lower position D. a means
  1. provides a timed relation between the movements of said working primary piston and said secondary piston E. and means mounting said working primary piston in said working cylinder for reciprocal motion between a top dead center position in which a fresh charge admitted over the said secondary piston through the said intake port and a bottom dead center position in which the essentially noncompressed said fresh charge over the said secondary piston passing through the said transfer passage and said transfer port to aid in expelling exhaust gases through said exhaust port.

* * * * *